US006249915B1

(12) United States Patent
Hang

(10) Patent No.: US 6,249,915 B1
(45) Date of Patent: Jun. 26, 2001

(54) BASEBALL GLOVES

(75) Inventor: Chan Chong Hang, Hong Kong (HK)

(73) Assignee: Joyful Long Industries, Ltd., Hong Kong (HK)

( * ) Notice: Subject to any disclaimer, the term of this patent is extended or adjusted under 35 U.S.C. 154(b) by 0 days.

(21) Appl. No.: 09/522,731

(22) Filed: Mar. 10, 2000

(51) Int. Cl.[7] ..... A41D 13/08
(52) U.S. Cl. ..... 2/19
(58) Field of Search ..... 2/19, 159, 161.1, 2/162

(56) References Cited

U.S. PATENT DOCUMENTS 2,629,096 * 2/1953 Latina ..... 2/19
3,042,929 * 7/1962 Kobos ..... 2/19
5,983,396 * 11/1999 Morrow et al. ..... 2/161.1

* cited by examiner

*Primary Examiner*—John J. Calvert
*Assistant Examiner*—Alissa L. Hoey
(74) *Attorney, Agent, or Firm*—Fish & Richardson P.C.

(57) ABSTRACT

Baseball gloves are provided that include an adjustable ball pocket. Some baseball gloves include a quick release adjustment device and a lacing pattern that allow the depth of the ball pocket to be easily adjusted by a wearer of the glove.

31 Claims, 3 Drawing Sheets

BASEBALL GLOVES

TECHNICAL FIELD

This invention relates to baseball gloves, and more particularly to baseball gloves having an adjustable pocket.

BACKGROUND

Baseball gloves are used in different ways, depending on the position being played by the wearer of the glove, and the individual playing style of the wearer. For example, a pitcher may use a baseball glove to hide his or her grip, a first baseman or catcher is primarily concerned with catching the ball, and an infielder is primarily interested in being able to quickly remove the ball from the glove for quick throwing. As a result, pitchers, first baseman and catchers generally prefer a deeper ball pocket than infielders. Even at a given position, different players have different personal preferences with regard to the depth of the ball pocket.

Attempts have been made to make baseball gloves adjustable to suit the preference of the wearer. For example, some baseball gloves include ball pockets that are adjustable by drawing up or loosening a laced portion of the ball pocket, e.g., as described in U.S. Pat. Nos. 2,452,695 and 2,510,218, or by selectively threading a lace through eyelets of varying spacing, as described in U.S. Pat. No. 5,379,460.

SUMMARY

The baseball gloves of the present invention include ball pockets that can be quickly and easily adjusted, e.g., so that the wearer can adjust the ball pocket depth during a game. In preferred baseball gloves, the depth of the ball pocket can be adjusted without tying or untying a knot or removing any of the lacing of the glove.

In one aspect, the invention features a baseball glove including (a) a glove body, constructed to receive a wearer's hand, defining at least a glove index finger and a glove thumb, (b) a webbing, extending between the glove index finger and the glove thumb, (c) an adjustment line disposed so as to adjustably fasten a side edge of the webbing to a side edge of the glove index finger and glove thumb to define a ball pocket of adjustable depth, and (d) a releasable adjustment device slidably arranged on the adjustment line to allow adjustment of the length of the adjustment line, to permit adjustment of the depth of the ball pocket, by sliding the adjustment device along the adjustment line to adjust the spacing between the side edge of the webbing and the opposed side edges of the glove index finger and glove thumb.

Preferred embodiments may include one or more of the following features. The releasable adjustment device is a spring button clamp. The adjustment line is laced between glove and webbing so as to allow adjustment of the depth of the ball pocket by adjusting the length of a portion of the adjustment line that extends from the ball pocket. The adjustment line extends from a lower portion of the ball pocket. The releasable adjustment device is positioned along the portion of the adjustment line. An upper edge of the ball pocket is fixedly attached at upper portions of the glove index finger and glove thumb. The adjustment line is laced through a plurality of guides on the ball pocket and the glove index finger and the glove thumb. The adjustment line is laced through the guides in a criss-crossing manner. The adjustment line is laced through the guides in a double-loop criss-crossed lacing pattern. The depth of the ball pocket can be adjusted without untying or removing the adjustment line.

In another aspect, the invention features a baseball glove including (a) a glove body, constructed to receive a wearer's hand, defining at least a glove index finger and a glove thumb, (b) a webbing, extending between the glove index finger and the glove thumb, (c) an adjustment line disposed so as to adjustably fasten a side edge of the webbing to a side edge of the glove index finger and glove thumb to define a ball pocket of adjustable depth, the adjustment line being laced so as to allow adjustment of the depth of the ball pocket by adjusting the length of a portion of the adjustment line that extends from the ball pocket, and (d) a securing line disposed so as to fixedly attach an upper portion of the webbing to upper edges of the glove index finger and glove thumb so that the spacing between the webbing and the glove index finger and glove thumb is substantially fixed at the upper edge of the ball pocket.

Preferred embodiments may include one or more of the following features. The portion of the adjustment line extends from a lower portion of the ball pocket. The adjustment line is laced through a plurality of guides on the ball pocket and the glove index finger and the glove thumb. The adjustment line is laced through the guides in a criss-crossing manner. The adjustment line is laced through the guides in a double-loop criss-crossed lacing pattern.

In a further aspect, the invention features a baseball glove including (a) a glove body, constructed to receive a wearer's hand, defining at least a glove index finger and a glove thumb, (b) a webbing, extending between the glove index finger and the glove thumb, (c) an adjustment line disposed so as to adjustably fasten a side edge of the webbing to a side edge of the glove index finger and glove thumb to define a ball pocket of adjustable depth, the adjustment line being laced in a double-loop criss-crossed lacing pattern.

Preferred embodiments may include one or more of the following features. The double-loop criss-crossed lacing pattern defines two loops, and the loops are substantially fixed in an upper area of the webbing so that the length of one of the loops is adjustable on the thumb side of the webbing and substantially fixed on the index finger side of the webbing, and the length of the other loop is adjustable on the index finger side of the webbing and substantially fixed on the thumb side of the webbing. The glove further includes a securing line disposed so as to fixedly attach an upper portion of the webbing to upper edges of the glove index finger and glove thumb so that the spacing between the webbing and the glove index finger and glove thumb is substantially fixed at the upper edge of the ball pocket.

The invention also features methods of adjusting the depth of a ball pocket of a baseball glove.

The term "baseball glove", as used herein, includes gloves used in baseball, softball, and other similar games.

Other features and advantages of the invention will be apparent from the description and drawings, and from the claims.

DETAILED DESCRIPTION

Figure 1:
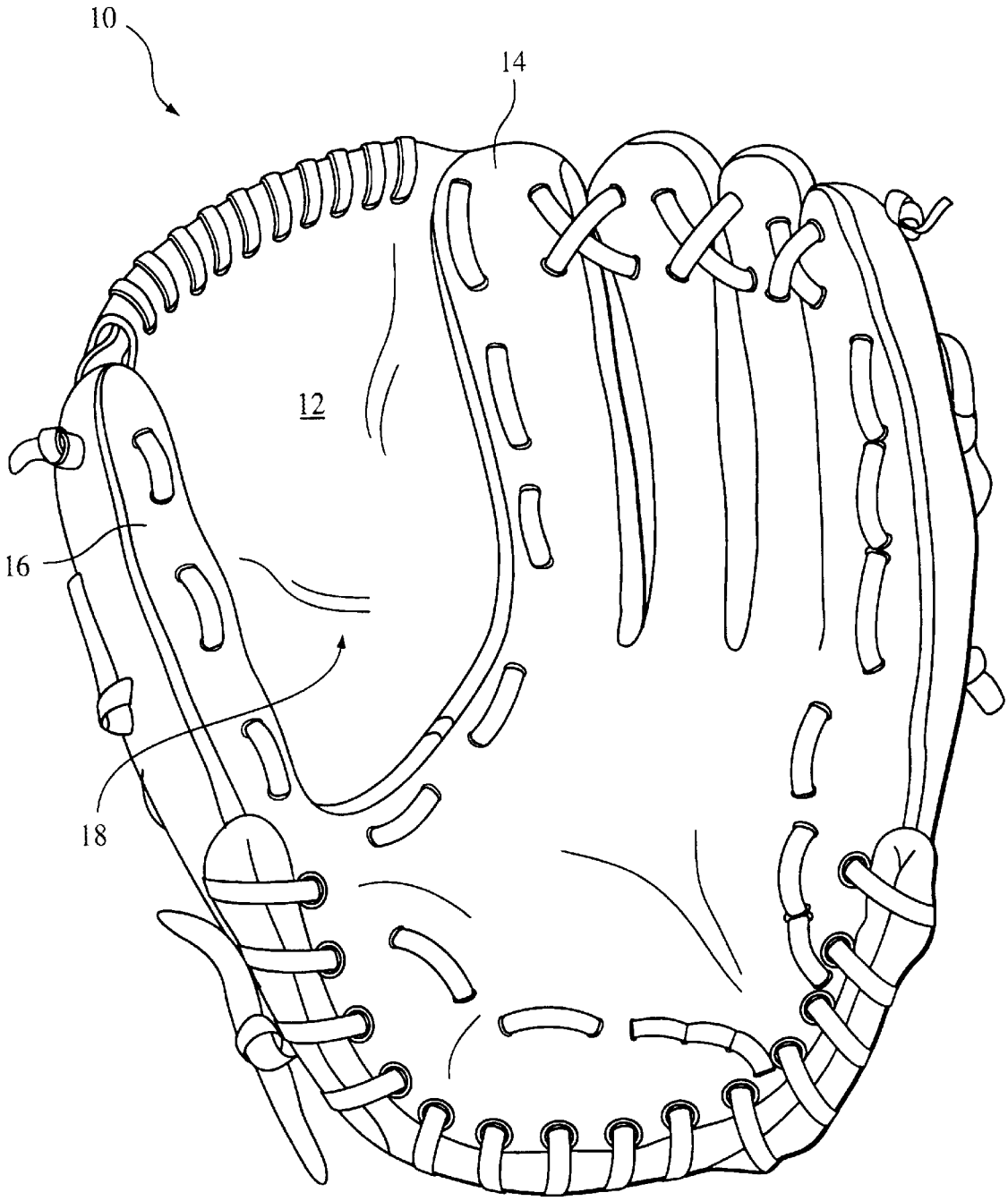
FIG. 1 is a front (palm-side) view of a baseball glove according to one embodiment of the invention

Referring to FIG. 1, a baseball or softball glove 10 has a webbing 12, e.g. of sheet or woven straps of leather or other suitable material, positioned to extend across the opening between the glove index finger 14 and the thumb 16 to create a ball pocket 18 for catching a ball.

Figure 2:
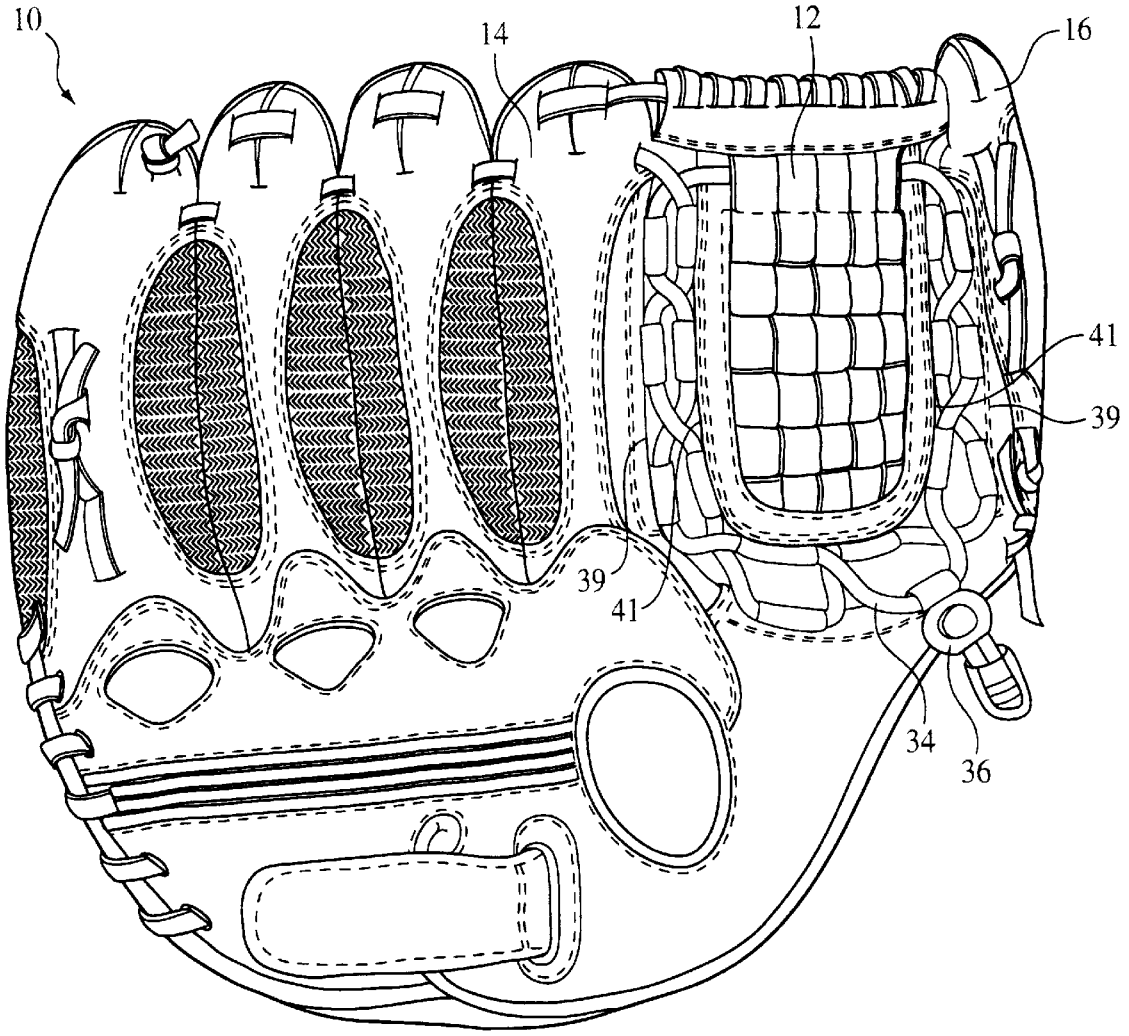
FIG. 2 is a rear view of the baseball glove of FIG. 1.
Figures 2A, 2B:
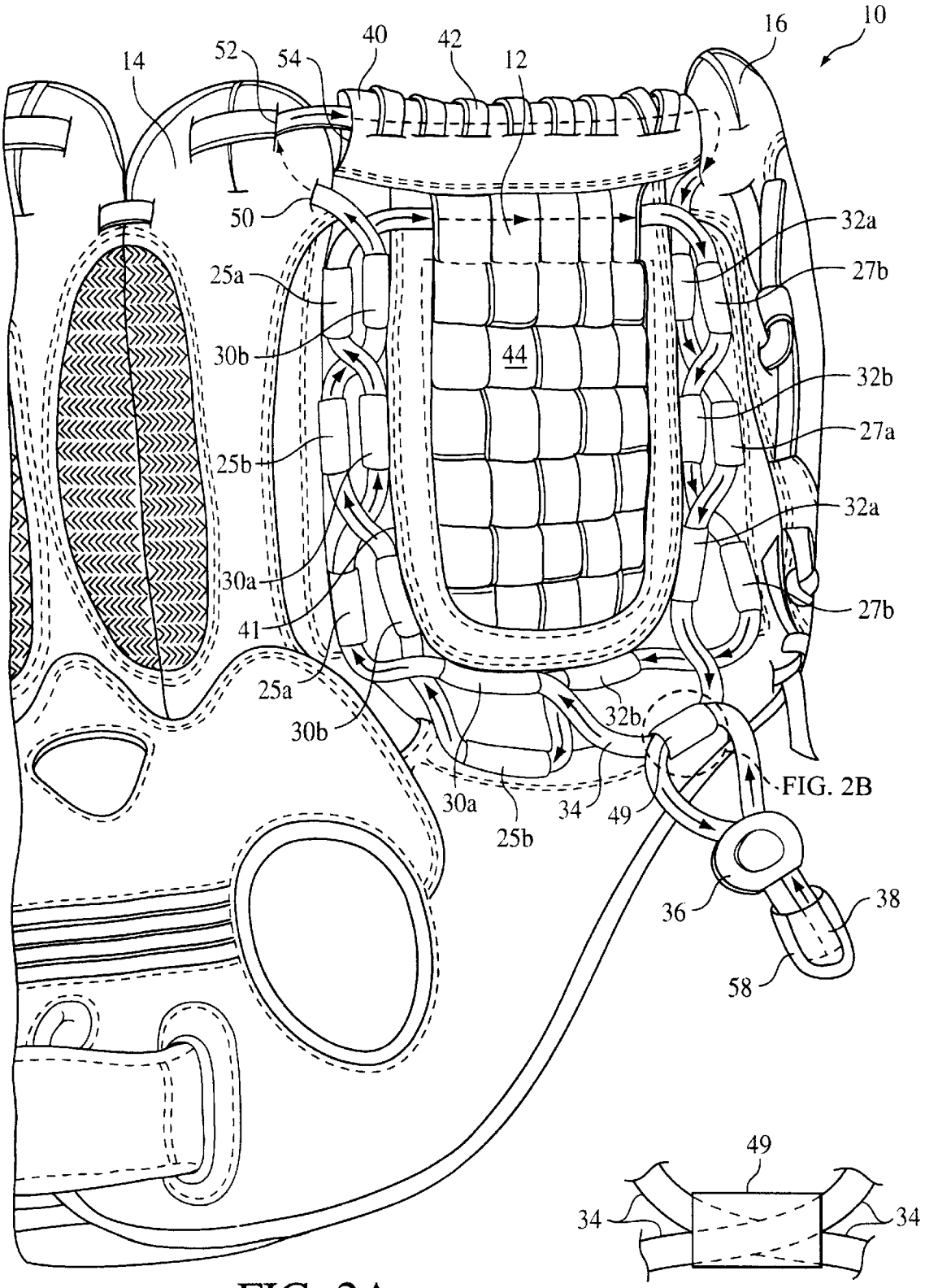
FIG. 2A is an enlarged partial rear view of the baseball glove of FIG. 1, with the lacing pattern of the adjustment line indicated by arrows and dotted lines.
FIG. 2B is a highly enlarged detail view of the lacing of the adjustment line through a guide.

Referring to FIGS. 2 and 2A, the upper edge portion 40 of the webbing is substantially fixedly attached between the upper portions of the index finger 14 and thumb 16 by lacing 42. The side edge 41 of the webbing is adjustably attached to the generally U-shaped edge 39 that is defined by the index finger, thumb and palm of the glove. The depth of ball pocket 18 can be adjusted, as will be discussed below, by varying the distance between edges 39 and 41.

A series of loops or guides 25*a*, 25*b*, 27*a* and 27*b* extend from edge 39 at the index finger 14 and thumb 16, respectively. A series of loops or guides 30*a*, 30*b*, 32*a* and 32*b* extend from the edge 41 of the webbing, generally opposite loops 25*a*, 25*b*, 27*a* and 27*b*, respectively. The body portion 44 of the webbing is positioned between the index finger and the thumb by an adjustment line 34, which is laced through these loops as indicated by the arrows in FIG. 2A and discussed below. The selected length of the adjustment line 34, and, in tum, the spacing between edges 39 and 41 and the resulting depth of the pocket, is maintained by releasable clamp 36 (e.g. a spring button clamp is shown) mounted at the ends of the adjustment line 34 (which preferably are secured together or connected to form a loop 38, as shown). (Thus, the clamp 36 maintains the length of the adjustment line that is on the webbing side of the clamp 36, which length determines the depth of the ball pocket.)

To loosen the adjustment line 34, and thereby provide a relatively deep pocket 28, the clamp 36 is moved along the adjustment line 34 toward the end of the adjustment line 34. The adjustment line 34 is then eased through loops 25*a* and 30*a*, on the index finger side of the webbing, and loops 27*a* and 32*a*, on the thumb side of the webbing, to increase the spacing between edge 39 and edge 41. Conversely, to provide a relatively shallower or tighter pocket 28, the adjustment line 34 is pulled through loops 25*a* and 30*a*, and 27*a* and 32*a*, to increase the length of the adjustment line extending below the webbing and decrease the distance between edges 39 and 41. Clamp 36 is then moved along the adjustment line 34 toward the base of the webbing to secure the adjustment line at this length.

As indicated by the arrows in FIG. 2A, the adjustment line 34 is laced in a pattern that will be referred to herein as a "double-loop criss-crossed lacing". Thus, starting at the lower right hand side of the loop 38 and following the direction of the arrows, the line 34 passes through clamp 36 and guide 49, is threaded upward through loops 25*a* and 30*a* along the index finger side of the webbing, through a channel in the body 44 of the webbing (dotted lines), and downward through loops 27*b* and 32*b* along the thumb side of the webbing. This completes the first "loop" of the lacing pattern. The line 34 is then laced, in criss-crossing fashion, over and under itself, upward through loops 25*b* and 30*b* along the index finger side of the webbing 12, enters an opening 50 in the index finger 14, passes through the index finger (dotted lines), exits the index finger at opening 52, passes through a channel 54 in the top edge 42 of the webbing (dotted lines), passes through the thumb 16 (dotted lines), and is threaded downward through loops 27*a* and 32*a* on the thumb side of the webbing. The adjustment line then passes through the guide 49, crossing itself as shown in FIG. 2B, to complete the second "loop" of the lacing pattern. Line 34 then passes again through the clamp 36 and is secured by holder 58 to form loop 38.

This lacing pattern allows the line 34 to be loosened and tightened by releasing or pulling it through loops 25*a*, 30*a*, 27*a* and 32*a*, as discussed above. The portion of the line that passes through loops 25*b*, 30*b*, 27*b* and 32*b* remains substantially stationary during adjustment of the depth of the ball pocket, due to the friction between the line 34 and the channels through which it passes at the top of the webbing.

The invention thus provides a baseball or softball glove having a ball pocket depth that can be adjusted to accommodate the user, or to accommodate the requirements of the field position to which the player is assigned. For example, the adjustment line may be loosened to create a deeper pocket to facilitate catching the ball, e.g., for use at a position where receiving the ball is the primary concern, e.g. at first base, or to permit the pitcher to better hide the nature of his or her grip on the ball prior to pitching. The adjustment line may also be tightened to make the ball pocket more shallow to facilitate removing the ball, for example for use at positions where removing the ball from the glove for throwing is a primary concern, e.g. at shortstop or other infield positions.

Other embodiments are within the claims. For example, while the invention has been described above as including an adjustment device, alternatively, adjustment can be performed by tightening or loosening the adjustment line as described above. The adjustment line may be secured, e.g., using a slip knot, bow, or other knot that could be quickly tied and untied by the user. Moreover, if an adjustment device is desired, any type of slidable, releasably locking device may be used.

What is claimed is:

1. A baseball glove comprising a glove body, constructed to receive a wearer's hand, defining at least a glove index finger and a glove thumb, a webbing, extending between said glove index finger and said glove thumb, an adjustment line disposed so as to adjustably fasten a side edge of the webbing to a side edge of the glove index finger and glove thumb to define a ball pocket of adjustable depth, said adjustable line at least disposed in a criss-cross manner between two webbing and index finger and a releasable adjustment device slidably arranged on said adjustment line to allow adjustment of the length of the adjustment line, to permit adjustment of the depth of said ball pocket, by sliding the adjustment device along the adjustment line to adjust the spacing between the side edge of the webbing and the opposed side edges of the glove index finger and glove thumb.

2. The baseball glove of claim 1 wherein said releasable adjustment device is a spring button clamp.

3. The baseball glove of claim 1 wherein said adjustment line is laced between glove and webbing so as to allow adjustment of the depth of the ball pocket by adjusting the length of a portion of the adjustment line that extends from the ball pocket.

4. The baseball glove of claim 3 wherein said portion of said adjustment line extends from a lower portion of the ball pocket.

5. The baseball glove of claim 3 wherein said releasable adjustment device is positioned along said portion of said adjustment line.

6. The baseball glove of claim 1 wherein an upper edge of the ball pocket is fixedly attached at upper portions of the glove index finger and glove thumb.

7. The baseball glove of claim 1 wherein said adjustment line is laced through a plurality of guides on said ball pocket and said glove index finger and said glove thumb.

8. The baseball glove of claim 7 wherein said line is laced through said guides in a criss-crossing manner.

9. The baseball glove of claim 8 wherein said line is laced through said guides in a double-loop criss-crossed lacing pattern.

10. The baseball glove of claim 1 wherein the depth of the ball pocket can be adjusted without untying or removing the adjustment line.

11. A baseball glove comprising a glove body, constructed to receive a wearer's hand, defining at least a glove index finger and a glove thumb, a webbing, extending between said glove index finger and said glove thumb, an adjustment line disposed so as to adjustably fasten a side edge of the webbing to a side edge of the glove index finger and glove thumb to define a ball pocket of adjustable depth, said adjustment line being laced so as to allow adjustment of the depth of the ball pocket by adjusting the length of a portion of the adjustment line that extends from the ball pocket to adjust the spacing between the side edge of the webbing and the opposed side edges of the glove index finger and glove thumb, and a securing line disposed so as to fixedly attach an upper portion of the webbing to upper edges of the glove index finger and glove thumb so that the spacing between the webbing and the glove index finger and glove thumb is substantially fixed at the upper edge of the ball pocket.

12. The baseball glove of claim 11 wherein said portion of the adjustment line extends from a lower portion of the ball pocket.

13. The baseball glove of claim 11 wherein said adjustment line is laced through a plurality of guides on said ball pocket and said glove index finger and said glove thumb.

14. The baseball glove of claim 13 wherein said line is laced through said guides in a criss-crossing manner.

15. The baseball glove of claim 14 wherein said line is laced through said guides in a double-loop criss-crossed lacing pattern.

16. A baseball glove comprising a glove body, constructed to receive a wearer's hand, defining at least a glove index finger and a glove thumb, a webbing, extending between said glove index finger and said glove thumb, an adjustment line disposed in at least one guide extending along a length of the index finger and the thumb so as to adjustably fasten a side edge of the webbing to a side edge of the glove index finger and glove thumb to define a ball pocket of adjustable depth, said adjustment line being laced in a double-loop criss-crossed lacing pattern.

17. The baseball glove of claim 16 wherein said double-loop criss-crossed lacing pattern defines two loops, and said loops are substantially fixed in an upper area of the webbing so that the length of one of said loops is adjustable on the thumb side of said webbing and substantially fixed on the index finger side of said webbing, and the length of the other loop is adjustable on the index finger side of said webbing and substantially fixed on the thumb side of the webbing.

18. The baseball glove of claim 16, further comprising a securing line disposed so as to fixedly attach an upper portion of the webbing to upper edges of the glove index finger and glove thumb so that the spacing between the webbing and the glove index finger and glove thumb is substantially fixed at the upper edge of the ball pocket.

19. A method of adjusting the depth of a ball pocket of a baseball glove, comprising:

(a) with a baseball glove providing (i) a glove body, constructed to receive a wearer's hand, defining at least a glove index finger and a glove thumb, (ii) a webbing, extending between said glove index finger and said glove thumb, (iii) an adjustment line disposed so (same as 16) as to adjustably fasten a side edge of the webbing to a side edge of the glove index finger and glove thumb to define a ball pocket of adjustable depth, and (iv) a releasable adjustment device slidably arranged on said adjustment line to allow adjustment of the depth of said ball pocket by sliding the adjustment device along the adjustment line to adjust the length of the adjustment line and thus the spacing between the side edge of the webbing and the opposed side edges of the glove index finger and glove thumb, adjusting the length of the adjustment line until a desired depth is obtained; and (b) securing the adjustment device in a position that will maintain the adjusted ball pocket depth.

20. A method of adjusting the depth of a ball pocket of a baseball glove, comprising:

with a baseball glove including (i) a glove body, constructed to receive a wearer's hand, defining at least a glove index finger and a glove thumb, (ii) a webbing, extending between said glove index finger and said glove thumb, (iii) an adjustment line disposed so as to adjustably fasten a side edge of the webbing to a side edge of the glove index finger and glove thumb to define a ball pocket of adjustable depth, said adjustment line being laced so as to allow adjustment of the depth of the ball pocket by adjusting the length of a portion of the adjustment line that extends from the ball pocket, and (iv) a securing line disposed so as to fixedly attach an upper portion of the webbing to upper edges of the glove index finger and glove thumb so that the spacing between the webbing and the glove index finger and glove thumb is substantially fixed at the upper edge of the ball pocket, adjusting the length of the portion of adjustment line to adjust the spacing between the side edge of the webbing and the opposed side edges of the glove index finger and glove thumb until a desired depth is obtained.

21. A baseball glove comprising:

a glove body, constructed to receive a wearer's hand, defining at least a glove index finger and a glove thumb, a webbing extending between and having an outer perimeter defined in part by said glove index finger and said glove thumb, an adjustment line disposed along the outer perimeter of the webbing so as to adjustably fasten a side edge of the webbing to a side edge of the glove index finger and said glove thumb to define a ball pocket of adjustable depth, the adjustment line having an adjustable length portion to permit adjustment of the depth of said ball pocket and the spacing between the side edge of the webbing and the opposed side edges of the glove index finger and glove thumb.

22. The baseball glove of claim 21 wherein the adjustment line is disposed along the outer perimeter of the webbing to form a first loop of a lacing pattern.

23. The baseball glove of claim 22 wherein the adjustment line is further disposed along the outer perimeter of the webbing to form a second loop of the lacing pattern.

24. The baseball glove of claim 23 wherein said line is attached between the glove body and webbing in a criss-crossing manner.

25. The baseball glove of claim 24 wherein said adjustment line is laced through a plurality of guides on said ball pocket and said glove index finger and said glove thumb.

26. The baseball glove of 24 further comprising a releasable adjustment device slidably arranged on said adjustment line to allow adjustment of the length of the adjustment line, to permit adjustment of the depth of said ball pocket, by sliding the adjustment device along the adjustment line to adjust the spacing between the side edge of the webbing and the opposed side edges of the glove index finger and glove thumb.

27. The baseball glove of claim 26 wherein said releasable adjustment device is a spring button clamp.

28. The baseball glove of claim 21 wherein said adjustment line is laced between glove and webbing so as to allow adjustment of the depth of the ball pocket by adjusting the length of a portion of the adjustment line that extends from the ball pocket.

29. The baseball glove of claim 28 wherein said portion of said adjustment line extends from a lower portion of the ball pocket.

30. The baseball glove of claim 30 wherein said releasable adjustment device is positioned along said portion of said adjustment line.

31. The baseball glove of claim 21 wherein an upper edge of the ball pocket is fixedly attached at upper portions of the glove index finger and glove thumb.

* * * * *